US008800508B2

(12) United States Patent
Koga et al.

(10) Patent No.: US 8,800,508 B2
(45) Date of Patent: Aug. 12, 2014

(54) LOOP SCAVENGED TWO-STROKE INTERNAL COMBUSTION ENGINE

(75) Inventors: Naoki Koga, Tokyo (JP); Takuo Yoshizaki, Tokyo (JP); Daisuke Yamada, Tokyo (JP)

(73) Assignee: Yamabiko Corporation, Tokyo (JP)

( * ) Notice: Subject to any disclaimer, the term of this patent is extended or adjusted under 35 U.S.C. 154(b) by 239 days.

(21) Appl. No.: 13/195,527

(22) Filed: Aug. 1, 2011

(65) Prior Publication Data

US 2012/0024276 A1 Feb. 2, 2012

(30) Foreign Application Priority Data

Aug. 2, 2010 (JP) ..... 2010-173674

(51) Int. Cl.
*F02B 25/00* (2006.01)

(52) U.S. Cl.
USPC ..... 123/73 PP; 123/65 P

(58) Field of Classification Search
USPC ..... 123/73 R, 73 PP, 65 P
See application file for complete search history.

(56) References Cited

U.S. PATENT DOCUMENTS 5,671,703 A 9/1997 Otome et al.
6,019,074 A * 2/2000 Otome ..... 123/65 P

FOREIGN PATENT DOCUMENTS

| | | |
|---|---|---|
| EP | 0773356 A2 | 5/1997 |
| EP | 2278137 A2 | 1/2011 |
| JP | 59134323 | 8/1984 |
| JP | 10-252480 | 9/1998 |
| JP | 2006-348785 | 12/2006 |
| JP | 2009-299605 | 12/2009 |

OTHER PUBLICATIONS

European Search Report EP 11005896, dated Oct. 25, 2011.

* cited by examiner

*Primary Examiner* — Noah Kamen
(74) *Attorney, Agent, or Firm* — Baker Botts LLP

(57) ABSTRACT

A loop scavenged two-stroke internal combustion engine which can effectively restrain blow-by of fresh gas with a relatively simple configuration is provided. A horizontal scavenging angle θb in at least one spot of a scavenging passage 31L located at one side of the pair of or a plurality of pairs of left and right scavenging passages is made to differ from a horizontal scavenging angle θa of a scavenging passage 31R located at the other side, and a main flow of a scavenging flow which is blown out from the scavenging passage 31L located at the one side and a main flow of a scavenging flow which is blown out from the scavenging passage 31R which is located at the other side intersect each other or collide with each other in plane view in a region displaced in a lateral direction from a center line C of an opening of an exhaust port 34.

2 Claims, 7 Drawing Sheets

<Present invention embodiment>

<Conventional example>

LOOP SCAVENGED TWO-STROKE INTERNAL COMBUSTION ENGINE

FIELD

The present application relates to a two-stroke internal combustion engine which is provided with a pair or a plurality of pairs of scavenging passages which adopt a reverse scavenging system, and particularly relates to a loop scavenged two-stroke internal combustion engine which can effectively restrain blow-by of fresh gas (unburnt air-fuel mixture).

BACKGROUND INFORMATION

Conventionally, in an ordinary two-stroke gasoline engine which has been used in a portable power working machine such as a lawn mower and a chain saw, a spark plug is placed at a head portion of a cylinder, an intake port, a scavenging port and an exhaust port which are opened and closed by a piston are formed at a barrel part of the cylinder, and one cycle of the engine is completed with two strokes of the piston without inclusion of independent strokes for only intake and exhaust.

In more detail, by the ascending stroke of the piston, an air-fuel mixture is taken into a crank-chamber under the piston from the intake port, the air-fuel mixture is pre-compressed by a descending stroke of the piston, the aforesaid pre-compressed air-fuel mixture is blown out into a combustion operation chamber above the piston from a scavenge port, and thereby, combustion waste gas is discharged to the exhaust port, in other words, the combustion waste gas is scavenged by using the gas flow of the air-fuel mixture.

Therefore, unburnt air-fuel mixture is easily included in the combustion waste gas (exhaust gas), the fresh gas (unburnt air-fuel mixture) which is directly discharged into the atmosphere without being used for combustion, a so-called blow-by amount is large, not only fuel efficiency is low as compared with a four-stroke engine, but also large amounts of HC (unburnt component of a fuel), CO (incomplete combustion component of a fuel) and the like which are harmful components are included in the exhaust gas. Thus, even if the engine is compact, there can be problems of concerns about environmental contamination, and how to respond to the exhaust gas control which is going to be increasingly strict henceforth and the demand for improvement of fuel efficiency.

In view of such problems, there have been conventionally proposed various techniques of restraining the aforesaid blow-by by improving the shape, structure and the like of scavenging passages as seen in, for example, JP Patent Publication (Kokai) No. 09-088617 A (1997), JP Patent Publication (Kokai) No. 2006-348785 A, JP Patent No. 83041 (Patent Showa 4 (1929)), JP Patent Publication (Kokai) No. 2009-299605 A and the like.

SUMMARY

The art described in the aforesaid JP Patent Publication (Kokai) No. 09-088617 A (1997) intends to restrain the aforesaid blow-by by blowing air into a combustion operation chamber from an outside (except for the scavenging passages) and generating a vertical vortex, but in this art, the blow-by restraining effect is not sufficient, in addition to which, air supply means is additionally required, and there arise the problems of complicating the configuration, causing increase in cost and the like.

The art described in the aforesaid JP Patent Publication (Kokai) No. 2006-348785 A (2006) intends to restrain the aforesaid blow-by by generating a vertical vortex by devising the sectional shape or the like of the scavenging passage, and thereby, improving the distributions of the exhaust gas and the mixture concentration in the combustion operation chamber, and in this art, the aforesaid blow-by restraining effect is not sufficient, either.

The aforesaid JP Patent No. 83041 (Patent Showa 4 (1929)) shows the state in which in a diesel engine, in order to restrain the aforesaid blow-by by generating a rotary flow in the combustion operation chamber, the effective passage areas of the scavenging passage located at the left side and the scavenging passage located at the right side are made to differ from each other, the scavenging flow which is blown out of the aforesaid scavenging passage located at the left side, and the scavenging flow which is blown out of the aforesaid scavenging passage located at the right side collide with each other in a region displaced in the lateral direction from the center line of the opening of the exhaust port. But even the art does not have a sufficient blow-by restraining effect, and has the problems of complicating the configuration, causing increase in cost and the like.

Further, JP Patent Publication (Kokai) No. 2009-299605 A discloses the art in which the scavenging passages are disposed laterally symmetrically with the vertical section (central vertical section) orthogonal to the rotational axial line of the crankshaft therebetween, the intake port and the exhaust port are provided eccentrically in plane view with respect to the aforesaid central vertical section respectively, and thereby, the scavenging passage is elongated to enhance the scavenging effect. But since in this art, the exhaust port is provided eccentrically with respect to the aforesaid central vertical section, the layout of the muffler is restricted, compactness of the entire layout tends to be lacked, and the thermal problem due to the mounting layout of the muffler tends to occur.

The present disclosure is made to respond to such demands, and one embodiment provides a loop scavenged two-stroke internal combustion engine which can effectively restrain blow-by of fresh gas with a relatively simple configuration.

In the same or another embodiment, a loop scavenged two-stroke internal combustion engine according to the present invention is basically provided with a pair of or a plurality of pairs of left and right scavenging passages which adopt a reverse scavenging system to cause a combustion operation chamber formed above a piston and a crank-chamber to communicate with each other, wherein a horizontal scavenging angle in at least one spot of a scavenging passage located at one side of the pair of or a plurality of pairs of left and right scavenging passages is made to differ from a horizontal scavenging angle of a scavenging passage located at the other side, and a main flow of a scavenging flow which is blown out from the scavenging passage located at the one side and a main flow of a scavenging flow which is blown out from the scavenging passage which is located at the other side intersect each other or collide with each other in plane view in a region displaced in a lateral direction from a center line of an opening of an exhaust port.

In the same or another embodiment, a horizontal scavenging angle formed by a guide wall surface located at an intake port side in the scavenging passage located at the one side, and a horizontal scavenging angle formed by a guide wall surface located at the intake port side in the scavenging passage located at the other side are made to differ from each other.

In the same or another embodiment, cross-sectional shapes or effective passage areas of the scavenging passage located at the one side and the scavenging passage located at the other side are made to differ from each other.

In the loop scavenged two-stroke engine the same or another embodiment, since the scavenging passage horizontal angles which are paired on the left and the right are made to differ from each other, the flow velocities of the scavenging flows which are blown out from the scavenging passages at the left and the right differ from each other, and the main flow of the scavenging flow which is blown out from the scavenging passage at one side and the main flow of the scavenging flow which is blown out from the scavenging passage at the other side are not collided with each other in the vicinity of the center line of the opening of the exhaust port as in the conventional example. Thereby, blow-by of the scavenging gas (fresh gas) at the early time of scavenging in particular is restrained, and the distance (time) until the scavenging gas (fresh gas) reaches the exhaust port is long, with the relatively simple configuration, whereby the time at which blow-by occurs is delayed, and as a result, blow-by in the middle term to the latter term can be restrained in particular.

DETAILED DESCRIPTION

Hereinafter, an embodiment of the present invention will be described with reference to the drawings.

Figure 1A:
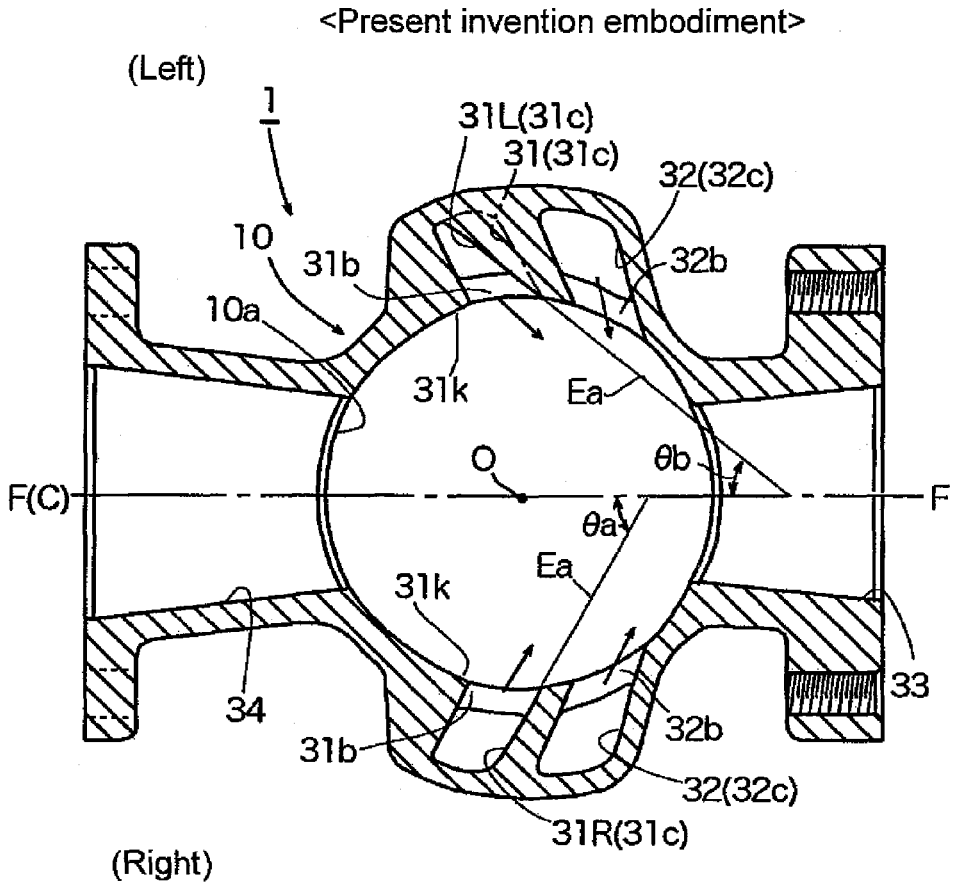
FIG. 1A is a horizontal sectional view showing a main part of one embodiment of a loop scavenged two-stroke engine according to the present invention (sectional view corresponding to a view seen along the arrows X-X of FIG. 4)
Figure 1B:
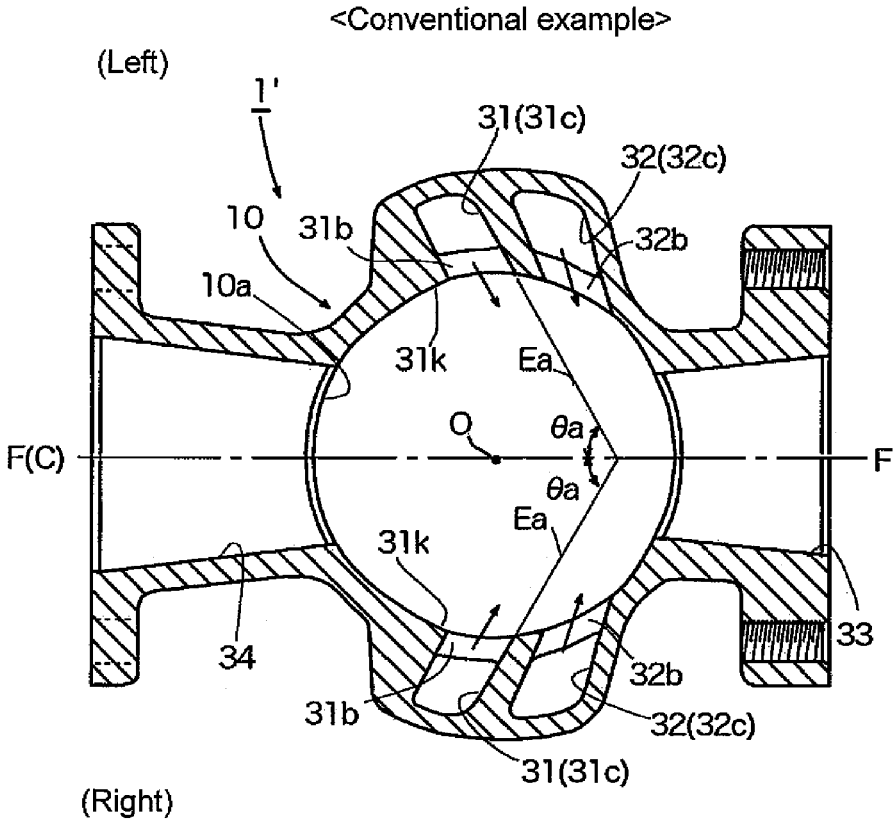
FIG. 1B is a horizontal sectional view showing a main part of one example of a conventional loop scavenged two-stroke engine (sectional view corresponding to a view seen along the arrows X-X of FIG. 4).
Figure 2A:
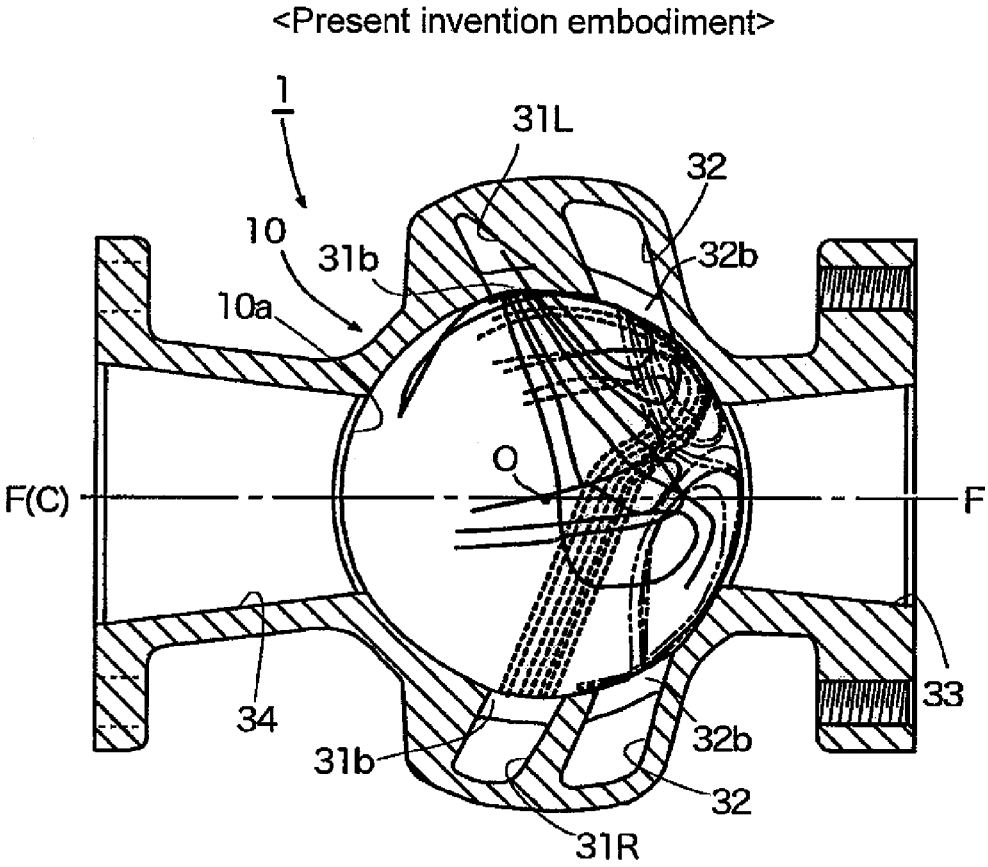
FIG. 2A is an analytical plane view provided for explanation of a scavenging flow of the embodiment of the present invention shown in FIG. 1A.
Figure 2B:
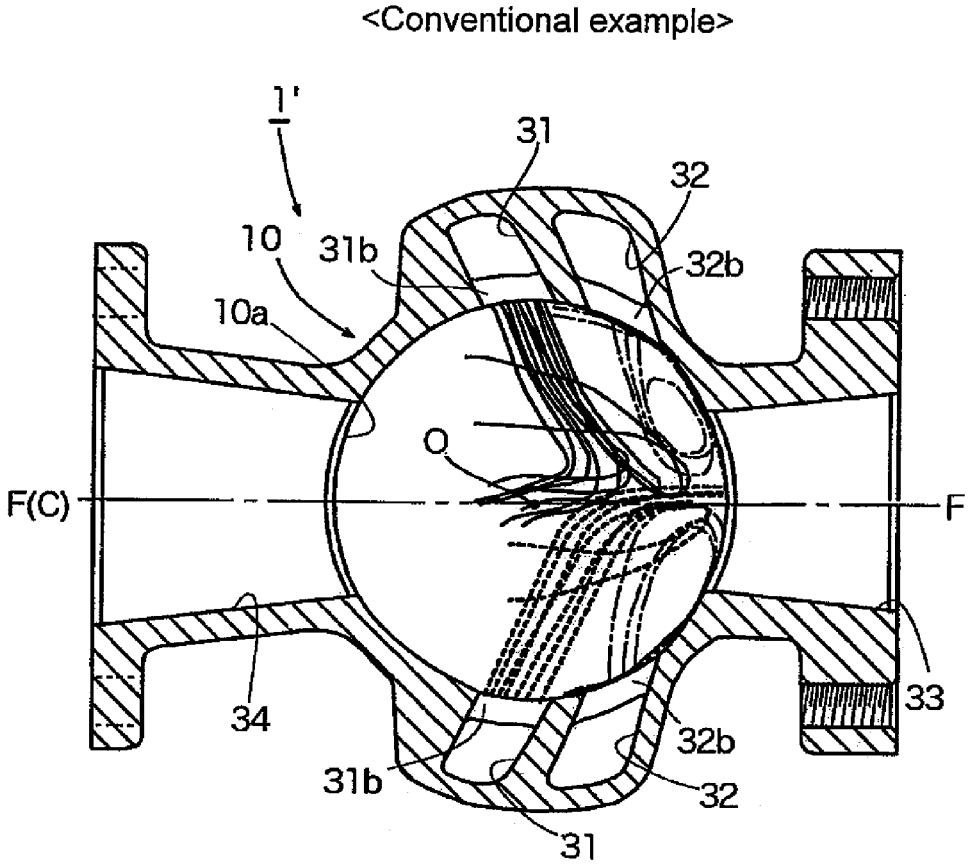
FIG. 2B is an analytical plane view provided for explanation of a scavenging flow of a conventional example shown in FIG. 1B.
Figure 3A:
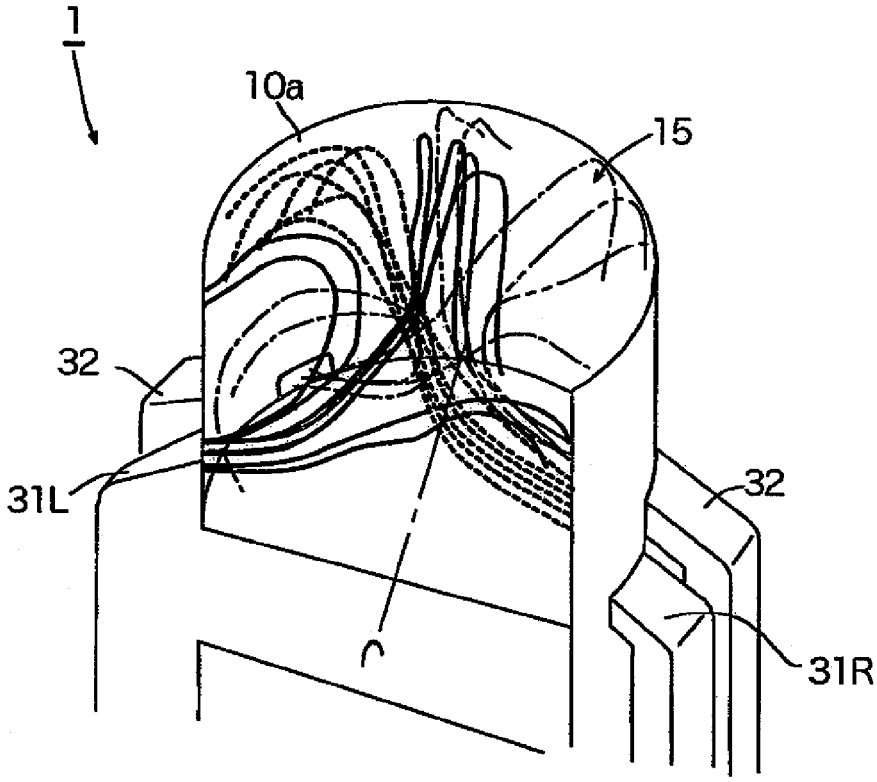
FIG. 3A is an analytical perspective view which is provided for explanation of the scavenging flow of the embodiment of the present invention shown in FIG. 1A.
Figure 3B:
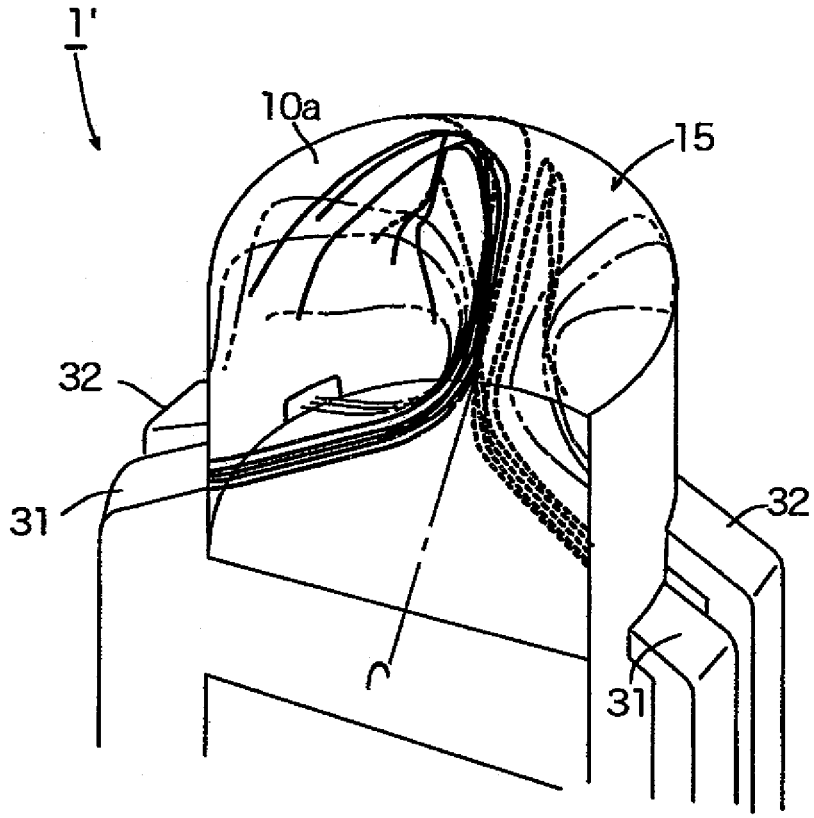
FIG. 3B is an analytical perspective view which is provided for explanation of the scavenging flow of the conventional example shown in FIG. 1B.
Figure 4:
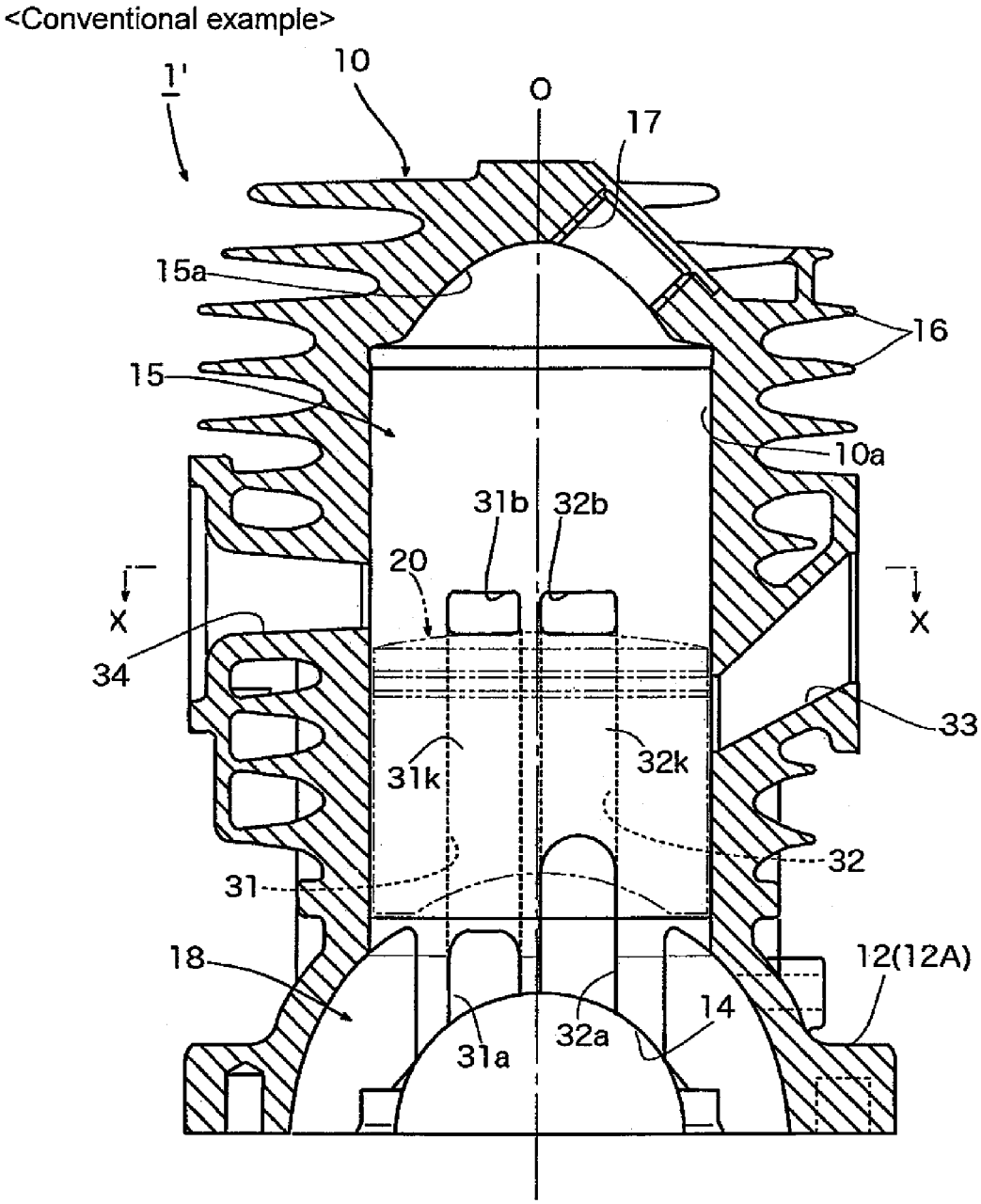
FIG. 4 is a vertical sectional view showing a main part of one example of a conventional loop scavenged two-stroke engine.

FIG. 1A is a horizontal sectional view showing a main part of one embodiment of a loop scavenged two-stroke engine according to the present invention (sectional view corresponding to a view seen along the arrows X-X of FIG. 4), FIG. 1B is a horizontal sectional view showing a main part of one example of a conventional loop scavenged two-stroke engine (sectional view corresponding to a view seen along the arrows X-X of FIG. 4), FIG. 2A is an analytical plane view provided for explanation of a scavenging flow of the embodiment of the present invention shown in FIG. 1A, FIG. 2B is an analytical plane view provided for explanation of a scavenging flow of a conventional example shown in FIG. 1B, FIG. 3A is an analytical perspective view which is provided for explanation of the scavenging flow of the embodiment of the present invention shown in FIG. 1A, FIG. 3B is an analytical perspective view which is provided for explanation of the scavenging flow of the conventional example shown in FIG. 1B, and FIG. 4 is a vertical sectional view showing a main part of one example of a conventional loop scavenged two-stroke engine.

In the engines of the embodiment of the present invention and the conventional example, the corresponding parts or the same functional parts are assigned with the same reference symbols.

In the following, an engine 1' of the conventional example [FIG. 4 and FIG. 1B, FIG. 2B, and FIG. 3B] will be described first, and the different parts from an embodiment of the present invention [FIG. 1A, FIG. 2A and FIG. 3A] will be described next.

The loop scavenged two-stroke engine 1' of the conventional example is a four-flow scavenging type compact air-cooling two-stroke gasoline engine for use in a portable power working machine or the like, and has a cylinder 10 in which a piston 20 is fitted with an upper crankcase 12A which configures an upper half of a crankcase 12 integrally formed at a lower side of the cylinder 10. To a lower side of the upper crankcase 12A, a lower crankcase is fastened in a sealed state by four through-bolts, for example, though not illustrated. The aforesaid crankcase 12 defines a crank chamber 18 under the aforesaid cylinder 10, and rotatably supports a crankshaft, which reciprocatingly raises and lowers the piston 20 via a connecting rod, via a main bearing.

On an outer peripheral portion of the aforesaid cylinder 10, a number of cooling fins 16 are provided, and at a head portion thereof, a combustion chamber portion 15*a* in the shape of a Squish dome (semi-spherical shape) configuring the combustion operation chamber 15, is provided. In the combustion chamber portion 15*a*, a fitting hole (female screw portion) 17 is formed, in which a spark plug (not illustrated) is attached.

Further, an exhaust port 34 is provided at one side of a barrel portion of the cylinder 10, and at the other side of the barrel portion, an intake port 33 is provided at a position lower than the exhaust port 34 (in FIG. 2, the exhaust port 34 and the intake port 33 are illustrated to be at the position at the same height).

Further, in the two-stroke engine 1' of the present conventional example, a pair of first scavenging passages (main scavenging passages) 31 and 31 which are located at the aforesaid exhaust port 34 side, and a pair of second scavenging passages (sub scavenging passages) 32 and 32 which are located at the opposite side (intake port 33 side) from the aforesaid exhaust port 34, which adopt a reverse scavenging system (Schnurle scavenging system), are provided in the aforesaid cylinder 10 and the aforesaid upper crankcase 12A. The first and the second scavenging passages 31 and 31 and 32 and 32 are respectively provided symmetrically with a central vertical section F-F (section orthogonal to a rotational axial line of the crankshaft and including a center line C of an opening of the exhaust port 34) which divides the intake port 33 and the exhaust port 34 into two equal parts.

Most of the aforesaid first and second scavenging passages 31, 31, 32 and 32 are passage portions with bulkheads 31*k*, 31*k*, 32*k* and 32*k*, and lower ends thereof are opened to a main bearing receiving surface (semi-cylindrical surface) 14 of the aforesaid upper crankcase 12A.

Cutout openings 31*a*, 31*a*, 32*a* and 32*a* each in a substantially rectangular shape to be scavenging inlet ports are formed at lower end portions of the respective bulkheads 31*k*, 31*k*, 32*k* and 32*k* in the aforesaid scavenging passages 31, 31, 32 and 32. In this case, the opening area and height of each of the scavenging inlet ports (cutout openings) 32*a* and 32*a* formed at the second scavenging passages 32 and 32 which are located at the intake port 33 side are made larger than the opening area and the height of each of the scavenging inlet ports (cutout openings) 31*a* and 31*a* which are formed at the first scavenging passages 31 and 31 which are located at the exhaust port 34 side.

Further, at upper ends (downstream ends) of the first scavenging passages 31 and 31 and the second scavenging passages 32 and 32, first scavenging outlet ports 31*b* and 31*b* and second scavenging outlet ports 32*b* and 32*b* each in a rectangular shape which open to the aforesaid combustion operation chamber 15 are provided. In this case, the height positions of the first scavenging outlet ports 31*b* and 31*b* and the second scavenging outlet ports 32*b* and 32*b* are set to be the same, and the height positions of the upper ends thereof are set to be lower than the upper end of the aforesaid exhaust port 34 by a predetermined distance. Accordingly, two pairs of the first scavenging outlet ports 31*b* and 31*b* and the second scavenging outlet ports 32*b* and 32*b* are simultaneously opened slightly later than the exhaust port 34 when the piston 20 descends.

The cross sectional shapes of the aforesaid first and second scavenging passages 31, 31, 32 and 32 are parallelograms with rounded corners in which the cylinder outer peripheral sides are the same as or slightly longer than the cylinder bore wall surface 10*a* sides over substantially entire regions in the lengthwise direction, a pair of left and right first scavenging passages 31 and 31 have the same (cross-sectional) shapes, and a pair of left and right second scavenging passages 32 and 32 have the same (cross-sectional) shapes. In this case, an intersection angle of an extension line Ea of a guide wall surface 31*c*, which defines the intake port 33 side of the left side first scavenging passage 31, to the intake port 33 side, and the exhaust port center line C, and a horizontal scavenging angle which is an intersection angle of the extension line Ea of the guide wall surface 31*c*, which defines the intake port 33 side of the right side first scavenging passage 31, to the intake port 33 side, and the exhaust port center line C are both set at the same angle θa (60 degrees), and the horizontal scavenging angles of a pair of left and right second scavenging passages 32 and 32 are set at the same angle on the left and the right.

In the two-stroke engine 1' of the conventional example which is configured as above, in the ascending stroke of the piston 20, the air-fuel mixture from mixture generating means such as a carburetor not illustrated is taken into the crank-chamber 18 from the aforesaid intake port 33 and is stored as the pressure in the crank-chamber 18 reduces.

When the air-fuel mixture in the combustion operation chamber 15 above the piston 20 is ignited to be exploded and combusted, the piston 20 is pressed down by the combustion gas. In the descending stroke of the piston 20, the air-fuel mixture in the crank-chamber 18 and the scavenging passages 31, 31, 32 and 32 are compressed by the piston 20, and when the exhaust port 34 is opened first, and the piston 20 further descends, the scavenging outlet ports 31*b*, 31*b*, 32*b* and 32*b* at the downstream ends of the scavenging passages 31, 31, 32 and 32 are simultaneously opened.

In the scavenging period in which the scavenging outlet ports 31*b*, 31*b*, 32*b* and 32*b* are opened, the air-fuel mixture which is compressed in the crank-chamber 18 is forced into the scavenging passages 31, 31, 32 and 32 from the scavenging inlet ports 31*a*, 31*a*, 32*a* and 32*a*, is sucked into the combustion operation chamber 15 side, and is blown out toward the cylinder bore wall surface 10*a* at the opposite side (intake port 33 side) from the exhaust port 34 with a predetermined horizontal scavenging angle as a scavenging flow, from the scavenging outlet ports 31*b*, 31*b*, 32*b* and 32*b*. Since in this case, the cross-sectional shapes and the horizontal scavenging angles of the scavenging passages 31 and 31 and 32 and 32 on the left and the right are the same, the scavenging flow which is blown out collides and is reversed (vertically rotated) in the vicinity of the center line C of the opening of the exhaust port 34 as shown in FIGS. 2B and 3B, and by the reversed scavenging flow, the combustion waste gas (exhaust gas) is forced out to the exhaust port 34.

The engine 1' of the conventional example which is described above and an engine 1 of the embodiment of the present invention differ in the cross-sectional shape and horizontal scavenging angle of the first scavenging passage 31 at the left side (hereinafter, the reference symbol of the first scavenging passage at the left side of the present embodiment is set as 31L, and the reference symbol of the first scavenging passage at the right side is set as 31R), and the first scavenging passages 31L and 31R are asymmetrical. More specifically, the cross-sectional shape of the first scavenging passage 31L at the left side of the present embodiment is formed into a shape close to a triangle (triangle with rounded corners), in which the cylinder outer peripheral side is the smallest and the cylinder bore wall surface 10*a* side is large over substantially the entire region in the lengthwise direction, rather than a parallelogram, and has its effective passage area made small [the one of the conventional example is shown by the phantom line in FIG. 1A], and furthermore, while the horizontal scavenging angle of the first scavenging passage 31R at the right side of the aforesaid conventional example and the present embodiment is set at θa (60 degrees), the horizontal scavenging angle of the first scavenging passage 31L at the left side of the present embodiment is set at θb (40 degrees).

As described above, as a result that the cross-sectional shapes and the horizontal scavenging angles of the first scavenging passage 31L at the left side and the first scavenging passage 31R at the right side are made to differ, as shown in analytical views in FIGS. 2A and 3A, the main flow of the scavenging flow which is blown out from the first scavenging passage 31L at the left side flows on the upper side of the main flow of the scavenging flow which is blown out from the first scavenging passage 31R at the right side to be reversed (vertically rotated). In other words, the main flow of the scavenging flow which is blown out from the first scavenging passage 31L at the left side and the main flow of the scavenging flow which is blown out from the first scavenging passage 31R at the right side do not collide with each other in the vicinity of the center line C of the opening of the exhaust port 34 as in the conventional example, but intersect each other in the region displaced to the left side from the center line C of the opening in plane view, the scavenging flow which is blown out from the first scavenging passage 31R at the right side flows along the bore wall surface 10*a* at the left side, whereas the scavenging flow which is blown out from the first scavenging passage 31L at the left side flows while spreading as compared with the scavenging flow which is blown out from the first scavenging passage 31R at the right side.

As above, in the engine 1 of the embodiment of the present invention, since the cross-sectional shapes and the horizontal scavenging angles of the first scavenging passages 31L and 31R on the left and the right are made to differ, the flow velocities of the scavenging flows which are blown out from the scavenging passages 31L and 31R at the left and the right differ from each other, and the main flow of the scavenging flow which is blown out from the first scavenging passage 31L at the left side and the main flow of the scavenging flow which is blown out from the first scavenging passage 31R at the right side do not collide with each other in the vicinity of the center line C of the opening of the exhaust port 34 as in the conventional example. Thereby, blow-by of the scavenging gas (fresh gas) at the early time of scavenging is restrained in particular, and the distance (time) until the scavenging gas (fresh gas) reaches the exhaust port 34 becomes long with the relatively simple configuration, whereby the time at which blow-by occurs is delayed, and as a result, blow-by in the middle term to the latter term can be restrained in particular.

In the above described embodiment, the engine having two pairs of scavenging passages is described, but one pair of, or three pairs or more of scavenging passages may be adopted. Further, in the above described embodiment, the horizontal scavenging angle at only one spot differs from the other ones, but the horizontal scavenging angles at a plurality of spots may differ from the other ones, and the cross-sectional shape of the scavenging passage can be properly selected without being limited to the parallelogram with rounded corners, the triangle with the rounded corners and the like.

Further, in the above described embodiment, the scavenging passages are disposed at the left and the right with the central vertical section orthogonal to the rotational axial line of the crankshaft, but the scavenging passages are not limited to this, and may be disposed at the left and the right with an inclined vertical section which is inclined at a predetermined angle in plane view with respect to the aforesaid central vertical section, and the present invention can be similarly applied to the one in which the intake port and/or the exhaust port are/is eccentrically provided in plan view with respect to the aforesaid central vertical section as in the one described in the aforementioned JP Patent Application Publication (Kokai) No. 2009-299605 A and the like.

DESCRIPTION OF SYMBOLS

1 LOOP SCAVENGED TWO-STROKE INTERNAL COMBUSTION ENGINE
10 CYLINDER
15 COMBUSTION OPERATION CHAMBER
20 PISTON
31L FIRST SCAVENGING PASSAGE AT LEFT SIDE
31R FIRST SCAVENGING PASSAGE AT RIGHT SIDE
32 SECOND SCAVENGING PASSAGE
31*b*, 32*b* SCAVENGING OUTLET PORT
31*c*, 32*c* GUIDE WALL SURFACE
33 INTAKE PORT
34 EXHAUST PORT
θa, θb HORIZONTAL SCAVENGING ANGLE

What is claimed is:

1. A loop scavenged two-stroke engine comprising:

one or more pairs of opposing first and second scavenging passages which adopt a reverse scavenging system to cause a combustion operation chamber formed above a piston and a crank-chamber to communicate with each other via the scavenging passages and to cause a scavenging gas in the crank-chamber to be sucked into the combustion operating chamber through the scavenging passages, wherein only a first guide wall surface located on an intake port side of the first scavenging passage and a second guide wall surface located on the intake port side of the second scavenging passage are disposed such that a first horizontal scavenging angle defined between a center line of an opening of an exhaust port and a first extension line extending from the first guide wall surface to the center line differs from a second horizontal scavenging angle defined between the center line of the opening of the exhaust port and a second extension line extending from the second guide wall surface to the center line, such that a main flow of a scavenging flow blown out from the first scavenging passage and a main flow of a scavenging flow blown out from the second scavenging passage intersect each other or collide with each other in plane view at a position shifted in a lateral direction from the center line of the opening of the exhaust port.

2. The loop scavenged two-stroke engine according to claim 1, wherein cross-sectional shapes or effective passage areas of the first scavenging passage and the second scavenging passage differ from each other.

* * * * *